US012138525B1

(12) United States Patent
France

(10) Patent No.: US 12,138,525 B1
(45) Date of Patent: Nov. 12, 2024

(54) SKI TETHERING ASSEMBLY

(71) Applicant: Kelvin France, King George, VA (US)

(72) Inventor: Kelvin France, King George, VA (US)

( * ) Notice: Subject to any disclaimer, the term of this patent is extended or adjusted under 35 U.S.C. 154(b) by 0 days.

(21) Appl. No.: 18/431,089

(22) Filed: Feb. 2, 2024

(51) Int. Cl.
*A63C 5/16* (2006.01)

(52) U.S. Cl.
CPC ..... *A63C 5/16* (2013.01)

(58) Field of Classification Search
CPC ..... A63C 5/16
See application file for complete search history.

(56) References Cited

U.S. PATENT DOCUMENTS

| | | | | |
|---|---|---|---|---|
| 3,907,320 | A | 9/1975 | Charneck | |
| 4,275,904 | A * | 6/1981 | Pedersen | A63C 5/16 280/14.1 |
| 5,152,728 | A * | 10/1992 | Podd, III | A63B 21/055 119/701 |
| 5,832,910 | A * | 11/1998 | Wolfrath | F41B 5/14 248/205.3 |
| 7,789,394 | B2 * | 9/2010 | Lendvay | A63B 67/10 273/331 |
| 2004/0173649 | A1 * | 9/2004 | Luedtke | A63C 11/025 224/258 |
| 2005/0263103 | A1 * | 12/2005 | Updyke | A01K 27/00 119/796 |
| 2010/0173273 | A1 * | 7/2010 | Bilbao | A63C 5/16 434/253 |
| 2013/0277956 | A1 * | 10/2013 | Walburn | A63C 5/16 280/818 |
| 2018/0093123 | A1 * | 4/2018 | Williams | A63B 23/03508 |
| 2023/0310971 | A1 * | 10/2023 | Farrell | A63C 7/02 280/604 |

FOREIGN PATENT DOCUMENTS

| | | | | |
|---|---|---|---|---|
| CA | 3061149 | C * | 8/2021 | B62B 3/02 |
| FR | 2579476 | A1 * | 10/1986 | |
| RU | 2471136 | C2 * | 12/2012 | |
| WO | WO-2016137355 | A1 * | 9/2016 | |

* cited by examiner

*Primary Examiner* — James A Shriver, II
*Assistant Examiner* — Michael T. Walsh
(74) *Attorney, Agent, or Firm* — Sanchelima & Associates, P.A.; Christian Sanchelima; Jesus Sanchelima

(57) ABSTRACT

A ski tethering assembly for securing a pair of skis in parallel configuration for transport and storage includes a skis assembly with left and right skis, each ski having a tip area, tail area, and central boot binding. Bracket assemblies are mounted to the tip and tail of each ski via a base and securing means. Each bracket has a pivoting head enabling rotation perpendicular to the base. Dual strap assemblies link between the front and rear brackets of the paired skis using adjustable tethers having distal end openings to engage fasteners secured in the pivoting bracket heads. This connects the skis at an optimal fixed distance while permitting some relative motion range. The strap assemblies spanning transversely between skis prevent excess drift while the pivoting brackets allow natural subtle alignment. The adjustable tether buckles and easy connecting/disconnecting mechanism retain parallel configuration for convenience without binding constraint.

2 Claims, 4 Drawing Sheets

SKI TETHERING ASSEMBLY

BACKGROUND OF THE INVENTION

1. Field of the Invention

The present invention relates to skiing assistance devices and, more particularly, to a ski tethering assembly that keeps skis tethered together and thus parallel, preventing a user's legs from drifting apart. This invention applies to both water and snow skiing.

2. Description of the Related Art

Several designs for devices enabling skis to be used whilst held in a particular configuration with respect to each other, e.g. for training purposes, have been designed in the past. None of them, however, provide a pair of straps secured between a pair of skis on the front and rear portions thereof, wherein said straps are secured to pivoting brackets.

Applicant believes a related reference corresponds to U.S. Pat. No. 3,907,320 issued for a Ski trainer. The "320" reference discloses ski trainers comprising means for retaining the right and left skies a select distance apart at both the front and tail, with the skies being a greater distance apart at the tail. Clamping devices are disclosed for attaching the trainers to the skies which will not mar or otherwise damage the skies. The ski trainers permit a beginner to rapidly learn the art of skiing with confidence.

Applicant believes that another related reference corresponds to U.S. Pat. No. 4,275,904 issued for mononose_conversion for twinskis. The "904" reference discloses a mononose structure which converts a pair of conventional skis into a twinski. The mononose structure is a tip which includes, a trailing portion of essentially the total width selected for the width of the twinski and a leading portion converging forwardly in a curved nose; a right-hand pocket to hold a conventional ski placed therein and a left-hand pocket to hold a conventional ski placed therein, the two pockets being separated by a central bridge section, and means cooperating with and associated with the mononose and with the pair of conventional skis for clamping the tips of conventional skis rigidly thereto. This provides the forward end of a twinski having an upwardly curved tip and bifurcated tail sections separated by a longitudinal slot. The rear ends of the conventional skis are tied together by tail bridge means at the tails of each of the conventional skis. This tail bridge means adjustably and floatingly holds the tails of the conventional skis in a predetermined, spaced-apart relation so that the lateral spacings are predetermined, but yet the tails are permitted to move vertically. The twinski thus provided extremely good maneuverability, good pivot turnability, controlled turns at substantially all speeds, good support on powder snow and excellent maneuverability in both packed and corn snow. The four edges provide greater control and the interconnected tail section works independently.

None of these references, however, teach of ski securing brackets, wherein the brackets are positioned on the front tips and near the rear ends of the skis. The tethers include an adjustable buckle and have an aperture at each end, wherein the apertures are configured to engage the pegs on the skis to tether the skis together.

Other documents describing the closest subject matter provide for a number of more or less complicated features that fail to solve the problem in an efficient and economical way.

None of these patents suggest the novel features of the present invention.

SUMMARY OF THE INVENTION

It is one of the objects of the present invention to provide a heightened level of security by being strategically positioned on both the front tips and near the rear ends of the skis. This dual placement ensures a comprehensive and reliable attachment, minimizing the risk of skis separating during use.

It is another object of this invention to provide a device, wherein the inclusion of adjustable buckles on the tethers allows users to easily customize the tightness of the connection between skis. This feature ensures adaptability to different skiing conditions and preferences, providing skiers with the flexibility to tailor the tethering to their specific needs.

It is another object of this invention to provide a device that is applicable to water skiing as well.

It is still another object of the present invention to provide a device, wherein the apertures in each end of the tethers are specifically configured to engage with pegs on the skis. This design not only simplifies the tethering process but also ensures a secure and stable connection. The efficient engagement mechanism adds convenience for users, making the overall skiing experience safer and more enjoyable.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
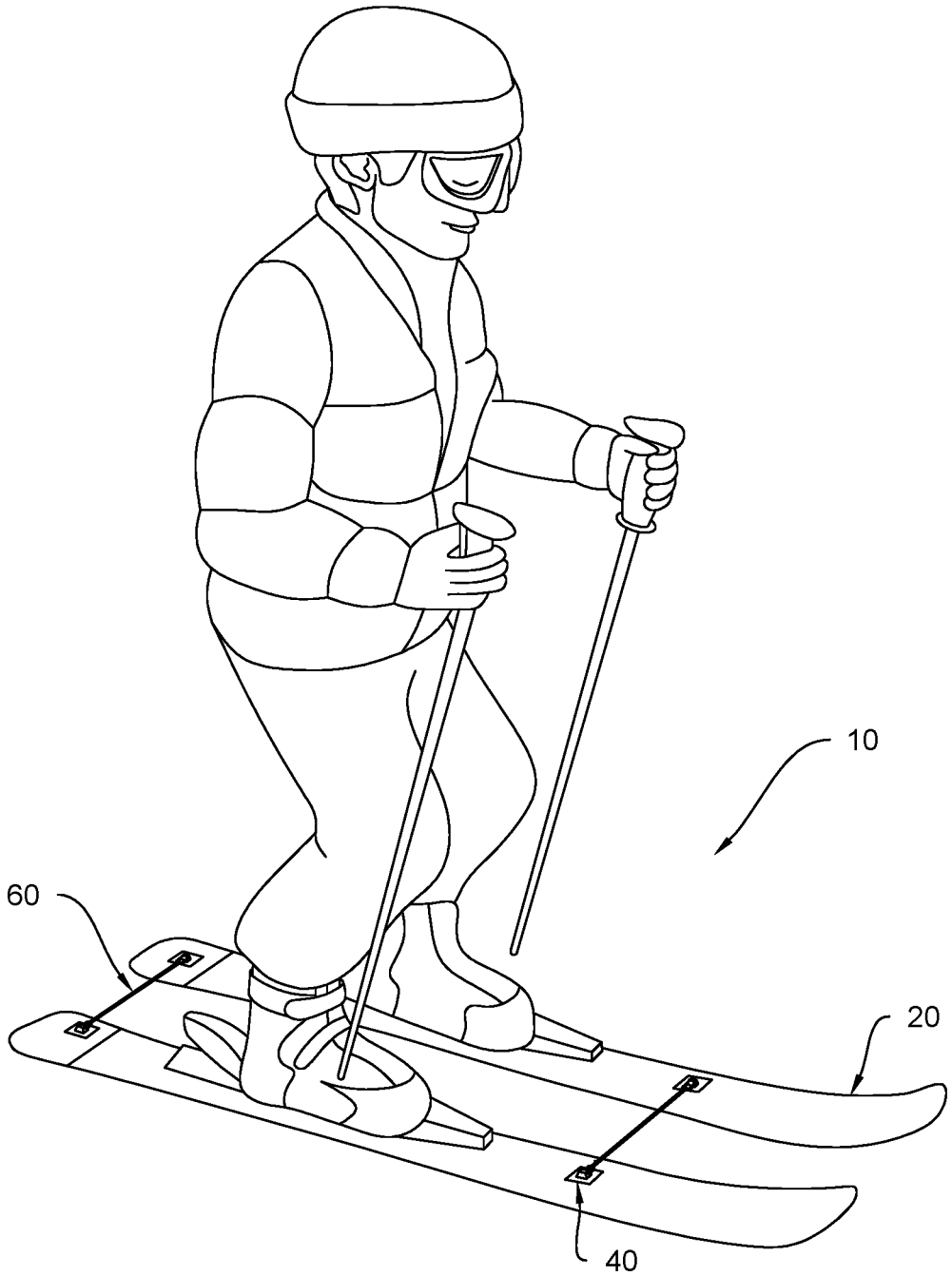
FIG. 1 represents an operational view of the present invention according to one embodiment thereof.

Referring now to the drawings, where the present invention is generally referred to with numeral 10, it can be observed that it basically includes a skis assembly 20, a bracket assembly 40, and a strap assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2:
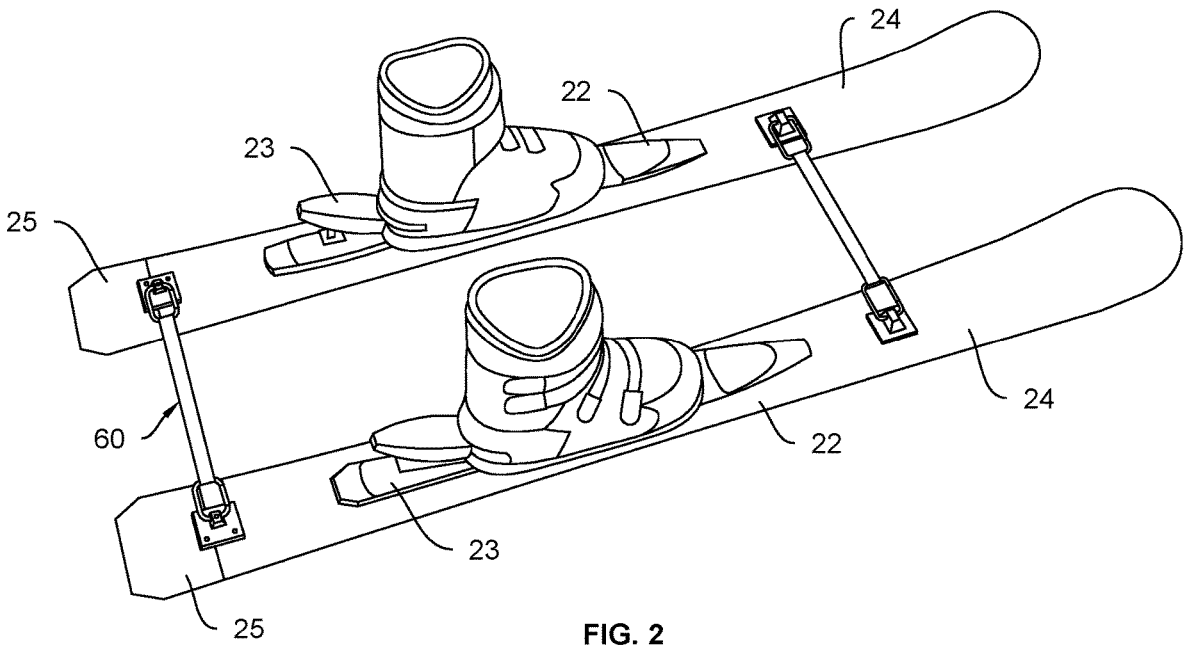
FIG. 2 shows a perspective view of the present invention as installed on a pair of skis.

FIG. 1 shows a skis assembly 20, a bracket assembly 40, and the strap assembly 60. The skis assembly 20, also referred to as skis, likely consists of two skis. Skis are typically elongated platforms made of materials like wood, fiberglass, metal, or plastic that glide over snow or water. Modern skis have evolved to be relatively short and wide compared to historical skinny skis, with widths in the range of 60-120 mm. Each ski may be slightly curved along the length. The bottom of each of the skis may be flat with steel edges on the sides for grip on hard snow, ice, and/or water. There may be slight concavity lengthwise (camber) to put more weight on the edges. The deck 22 refers to the top surface of the ski that brackets and bindings attach to. Additionally, the skis assembly 20 may include boot bindings 23 located centrally along the length of each ski. Ski boot bindings 23 are devices used to attach boots to skis, allowing the skier to securely connect their feet and legs to the skis. They enable transferring motion and control from the skier's body to the skis. Typically constructed of materials like steel alloy or sturdy plastics, the bindings 23 may utilize adjustable straps or clamps to firmly fix rigid mount points protruding from the bottom of ski boots to the ski deck. Boot bindings 23 may allow the boot to pivot at the toe and heel for flexibility. Release mechanisms may be integrated into the bindings to detach the boot in case of a fall to mitigate injury. Common binding systems include plate bindings mounted flat to the ski deck, and track mounted bindings with rails that allow adjusting boot position. The centrally mounted location provides stability for maneuvering the skis by putting body weight near the midpoint balance. Each ski 20 may have a tip 24. In one embodiment, each tip may be bent up to facilitate turning. As illustrated in FIG. 2, the tail end of each individual ski 25 may have little upward bend or curvature. The tails 25 may be as largely flat and oriented in the same plane as the rest of the elongated ski platform. This indicates traditional alpine ski geometry with tips lifted up to facilitate turn initiation, but tails that remain flat on the snow to provide stability and support driving out of turns. In some instances well-known skis, structures and/or techniques have not been shown or described in detail as these are known to one skilled in the art. Therefore, specific details disclosed herein are not to be interpreted as limiting, but rather as a basis and/or principle for the claims, and/or as representative basis for teaching one skilled in the art to employ this invention in virtually appropriately detailed system, structure, or matter.

Figure 3:
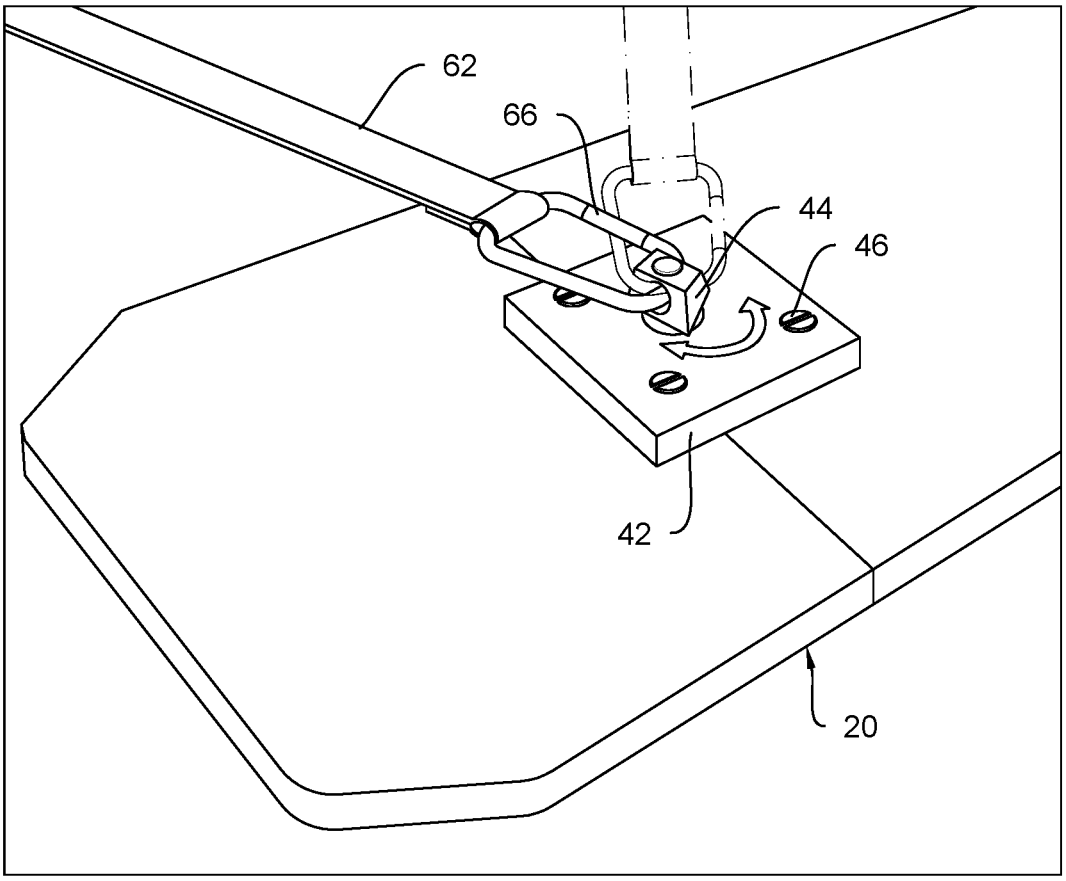
FIG. 3 is a representation of a closed up view of the bracket assembly according to one exemplary embodiment thereof.

The bracket assembly 40 may be mounted onto each of the skis as depicted in FIG. 1. The suitable configuration to attach the bracket assembly 40 is: attach one bracket assembly 40 on the tip 24 and another bracket assembly 40 on the tail 25 of each ski, so that each ski has a pair of brackets to tether them with the strap assembly 60. As detailed in FIG. 3 the bracket assembly includes a base 42, a pivoting head 44 (also termed as a peg), and securing means 46. In one embodiment, the bracket assembly 40 may be constructed from materials such as metals, fibers, polymers, or the like. As depicted in exemplary FIG. 3, the base 42 may have a rectangular geometry that is mounted onto the deck 22. In other suitable embodiments, the base 42 may have a circular shape, a quadrangular shape, a regular or irregular shape. The base 42 may be centrally mounted on either the tip 24 or the tail 25. The lateral sides of the base 42 may be equidistant from the lateral sides of the ski. To effectively secure this instance of the base 42 onto the deck 22, the base may have bores to receive the securing means 46 embodied as screws or permanently attached using, for instance, 3M™ products.

Mounted to the central region of the base 42 is a pivoting head piece 44. This head component is attached securely to the main bracket body in a manner that still enables free rotation and swiveling along the axis perpendicular to the base, as denoted in FIG. 3 by the arrow around the piece 44. This allows adjustment of the head orientation as the user moves without being permanently fixed. The pivoting functionality provides greater flexibility when attaching other hardware using the interface port integrated on the head. Specifically, the pivoting headpiece 44 may have an opening feature cut out from its exterior face. This opening allows the insertion of supporting attachments from the strap assembly 60.

Figure 4:
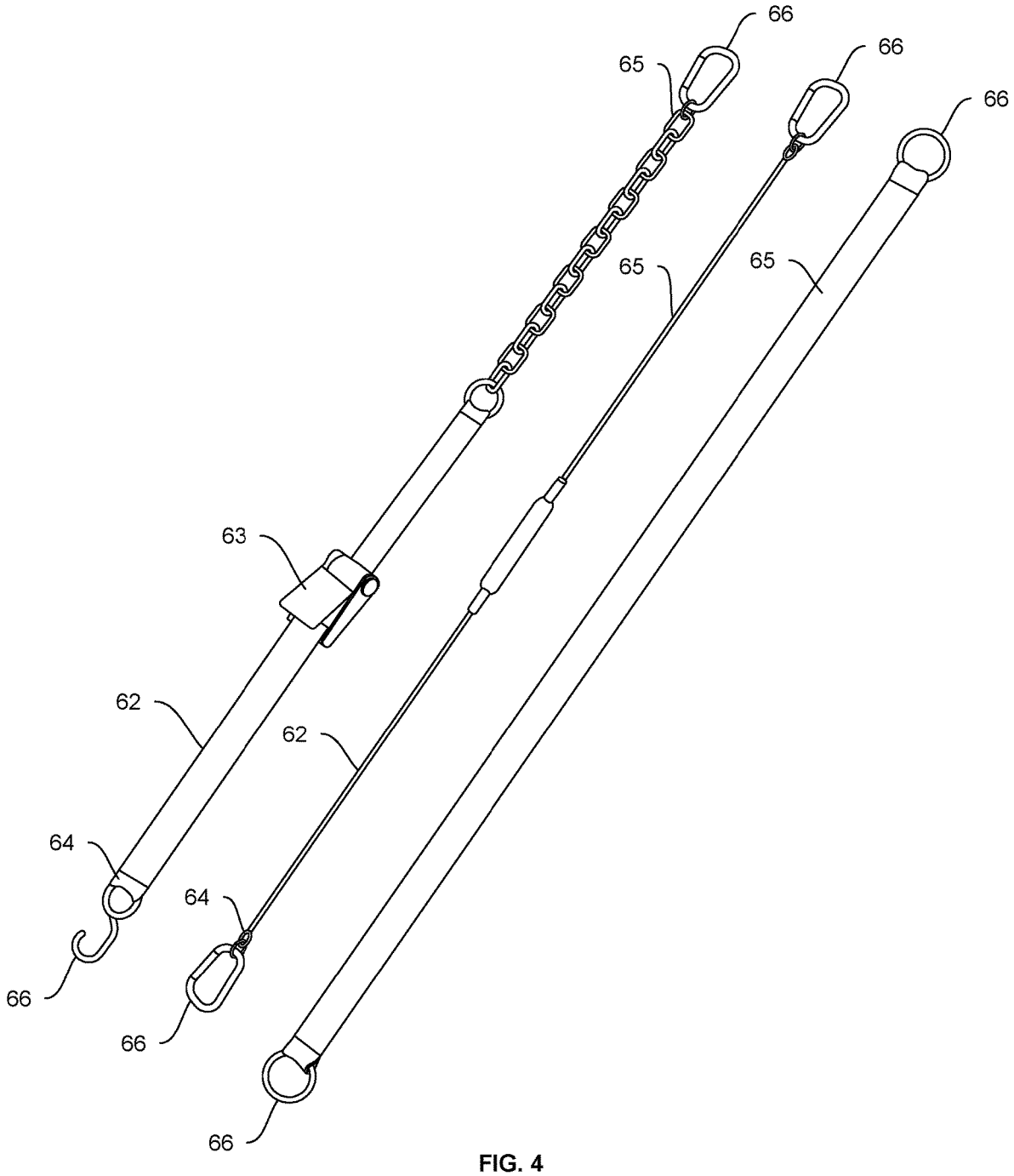
FIG. 4 shows a perspective view of the strap assembly according to various embodiments thereof.

The strap assembly 60 functions to secure the two skis at an optimal distance apart. It includes an elongated tether member 62, also termed as tether 62 and/or strap 62, with fasteners 66 fastened at both the first 64 and second distal ends 65 thereof. Wherein each distal end may have a loop/opening to receive the fasteners. This allows connection to the pivoting headpiece 44 mounted to each ski via insertion of the fasteners into the openings of each of the pivoting headpiece 44. The tether 62 spans transversely between the left and right skis when oriented tips are pointed forward, linking between the front tip brackets and also the rear tail brackets independently. Specifically, and as depicted in FIG. 1-2, there are two separate strap assemblies 60—one pairing the front brackets and one pairing the rear. Each of the tethers 62 are adjustable in length through use of a sliding buckle mechanism 63 incorporated along the span. This allows drawing the skis closer together or letting them extend farther apart to align with various ski/pole sizes for a custom fit. The pivoting nature of the mounted bracket assemblies 40 and dual connection points work synergistically to retain the skis at an ideal fixed distance while still permitting some freedom of relative motion. Referring now to FIG. 4, there is shown a view of multiple embodiments of the straps of the present invention. The straps can be composed of various materials, including but not limited to, chain, nylon, fabric, or the like.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A ski tethering assembly, comprising:

a) a skis assembly formed by a left and a right ski, each having a tip and a tail area;

b) a bracket assembly including:

a rectangular base mounted onto a deck of each of the skis by screws located at corners of the rectangular base;

a pivoting head centrally attached securely to the rectangular base in a manner that enables free rotation and swiveling along the axis perpendicular to the base; wherein said pivoting head has an opening perpendicular to a longitudinal axis thereof thereby defining a peg-like securing bracket;

wherein four of said peg-like securing brackets are positioned, one each, on the front tips and proximal to the tail area of the left and right skis;

c) a strap assembly including:

a tether having a first distal end and a second distal end, wherein each distal end has an opening;

carabiner clips attached to said distal ends through the openings;

the tether is adjustable in length through use of a sliding buckle mechanism incorporated along a span thereof;

d) wherein bracket assemblies are removably attached thereon;

e) one strap assembly links the bracket assemblies mounted onto the tip area of each ski, defining a front strap, whereas another strap assembly links the bracket assemblies mounted onto the tail area of each ski, defining a rear strap; the strap assemblies are engaged to the bracket assemblies by engaging each of the carabiner clips to each of the four peg-like securing brackets to tether the skis together; wherein the sliding buckle mechanism of each strap assembly adjusts a tightness of a connection between skis;

f) wherein each ski has a boot binding along the deck and is located between the peg-like securing brackets.

2. A ski tethering assembly, consisting of:

a) a skis assembly formed by a left and a right ski, each having a tip and a tail area;

b) a bracket assembly including:

a rectangular base mounted onto a deck of each of the skis by screws located at corners of the rectangular base;

a cylindrical pivoting head centrally attached securely to the rectangular base in a manner that enables free rotation and swiveling along a longitudinal axis thereof, which is perpendicular to the base; wherein said pivoting head has a central opening perpendicular to the longitudinal axis thereof, thereby defining a peg-like securing bracket;

wherein four of said peg-like securing brackets are position on the front tips and proximal to the tail area of the left and right skis;

c) a strap assembly including:

a tether having a first distal end and a second distal end, wherein each distal end has an aperture;

carabiner clips attached to said distal ends through the apertures;

the tether is adjustable in length through use of a sliding buckle mechanism incorporated along a span thereof;

d) wherein bracket assemblies are removably attached on said deck;

e) one strap assembly links the bracket assemblies mounted onto the tip area of each ski, defining a front strap, whereas another strap assembly links the bracket assemblies mounted onto the tail area of each ski, defining a rear strap; the strap assemblies are engaged to the bracket assemblies by engaging each of the carabiner clips to each of the four peg-like securing brackets to tether the skis together;

wherein the sliding buckle mechanism of each strap assembly adjusts a tightness of a connection between skis;

f) wherein each boot binding is located between the peg-like securing brackets.

* * * * *